US011395547B2

(12) United States Patent
Brunner et al.

(10) Patent No.: US 11,395,547 B2
(45) Date of Patent: Jul. 26, 2022

(54) RACK SYSTEM

(71) Applicant: KETER PLASTIC LTD., Herzliya (IL)

(72) Inventors: Yaron Brunner, Kibbutz Gvat (IL); Izhar Shani, Kibbutz Gvat (IL); Uri Parizer, Kibbutz Hukok (IL)

(73) Assignee: Keter Plastic Ltd., Herzliya (IL)

( * ) Notice: Subject to any disclaimer, the term of this patent is extended or adjusted under 35 U.S.C. 154(b) by 0 days.

(21) Appl. No.: 16/973,751

(22) PCT Filed: Jun. 18, 2019

(86) PCT No.: PCT/IL2019/050679
§ 371 (c)(1),
(2) Date: Dec. 9, 2020

(87) PCT Pub. No.: WO2020/008448
PCT Pub. Date: Jan. 9, 2020

(65) Prior Publication Data

US 2021/0251383 A1 Aug. 19, 2021

(30) Foreign Application Priority Data

Jul. 1, 2018 (IL) ..... 260350

(51) Int. Cl.
*A47B 96/06* (2006.01)
*A47B 57/32* (2006.01)
(Continued)

(52) U.S. Cl.
CPC ..... *A47B 96/061* (2013.01); *A47B 57/32* (2013.01); *A47B 57/40* (2013.01); *A47B 96/07* (2013.01); *A47B 2200/0036* (2013.01)

(58) Field of Classification Search
CPC ..... A47B 57/40; A47B 57/32; A47B 96/061; A47B 96/07; A47B 2200/0036
(Continued)

(56) References Cited

U.S. PATENT DOCUMENTS 2,622,834 A * 12/1952 Sparring ..... A47B 57/42 248/243
3,351,212 A * 11/1967 McConnell ..... A47B 57/408 211/192
(Continued)

FOREIGN PATENT DOCUMENTS

DE 20 2009 013523 U1 3/2010
GB 2449934 A * 12/2008 ..... A47B 57/16
(Continued)

*Primary Examiner* — Daniel J Troy
*Assistant Examiner* — Timothy M Ayres
(74) *Attorney, Agent, or Firm* — Vorys, Sater, Seymour and Pease LLP; William L. Klima

(57) ABSTRACT

Provided are rack systems including at least one support rail configured with a plurality of axially extending bracket arresting slots and a plurality of corresponding locking locations, and at least one support bracket including at least two axially disposed engaging hooks readily detachably attachable with any two or more of the bracket arresting slots of the support rail, said support bracket further including a locking mechanism including a locking plunger configured for engaging with a locking location at the support rail.

22 Claims, 12 Drawing Sheets

(51) Int. Cl.
*A47B 57/40* (2006.01)
*A47B 96/07* (2006.01)

(58) Field of Classification Search
USPC ..... 248/200
See application file for complete search history.

(56) References Cited

U.S. PATENT DOCUMENTS

| | | | | | |
|---|---|---|---|---|---|
| 4,171,789 | A | * | 10/1979 | Vander Hoek | A47B 57/42 248/243 |
| 4,406,374 | A | * | 9/1983 | Yedor | A47B 57/40 211/192 |
| 5,022,621 | A | | 6/1991 | Quest | |
| 5,116,007 | A | * | 5/1992 | Von Gunton | A47B 57/42 108/108 |
| 5,185,971 | A | | 2/1993 | Johnson, Jr. | |
| 5,494,246 | A | * | 2/1996 | McCarthy | A47B 57/40 211/192 |
| 5,538,213 | A | | 7/1996 | Brown | |
| 6,202,965 | B1 | | 3/2001 | Chong | |
| 6,978,975 | B1 | | 12/2005 | Magnusson | |
| 2007/0221597 | A1 | * | 9/2007 | Chen | A47B 96/028 211/192 |
| 2007/0257169 | A1 | | 11/2007 | Taggett | |
| 2008/0067909 | A1 | * | 3/2008 | Hanson | A47B 96/061 312/408 |

FOREIGN PATENT DOCUMENTS

| | | | |
|---|---|---|---|
| JP | 62-120840 | U | 7/1987 |
| JP | 04-38731 | U | 4/1992 |

* cited by examiner

RACK SYSTEM

TECHNOLOGICAL FIELD

The present disclosure concerns rack systems.

BACKGROUND ART

References considered to be relevant as background to the presently disclosed subject matter are listed below:
U.S. Pat. No. 5,022,621
U.S. Pat. No. 5,185,971
U.S. Pat. No. 5,538,213
U.S. Pat. No. 6,978,975

Acknowledgement of the above references herein is not to be inferred as meaning that these are in any way relevant to the patentability of the presently disclosed subject matter.

BACKGROUND

U.S. Pat. No. 5,022,621 is directed to a multi-hooks bracket adapted to hookably attach into vertically spaced and vertically elongated apertures of a multi-apertured column whereby the hookably attached bracket is adapted to cantileverly support office equipment, an improved multi-hooks bracket structure that is resistant to upward dislodgement from the multi-apertured column, said improved bracket structure comprising: (A) a generally horizontally extending arm having a periphery comprising a substantially horizontally upper-edge adapted to support office equipment thereat and also comprising an upright rear-side; (B) a plurality of vertically spaced hooks arrayed along an upright first-plane, each hook extending horizontally rearwardly and then downwardly from the arm rear-side whereby each hook is adapted to extend into and partially occupy the height of a vertically elongate aperture of a said multi-apertured column; and (C) a horizontally elongate lock located along said first-plane and at the arm rear-side, said lock having an elevation between consecutive bracket hooks and being horizontally reciprocatably associated with said arm so as to move along the horizontal portion of a said consecutive hook toward the unoccupied height remainder of a said partially occupied column aperture, and said lock having an inclined notchably serrated rear-end contour adapted to removably securely plug-into said column aperture unoccupied height remainder to thereby prevent upward dislodgement of said bracket from a said multi-apertured column.

U.S. Pat. No. 5,185,971 discloses a channel adapted to fit within a slotted wall panel, comprising an elongated extruded member, which, in cross section, including: (a) a substantially U-shaped central box member, comprising a face plate adapted to be exposed on and oriented substantially parallel to an exposed surface of the panel, and two box support members extending substantially perpendicular from the face plate, adapted to extend into the panel from the face plate; (b) a flange member extending from each of the support members, comprising a flange plate connected to one of the support members and extending substantially parallel to the face plate, and a flange support member connected to the flange plate and extending substantially perpendicular to the flange plate, the two box support members and the flange support members being oriented substantially parallel to each other, and terminating in substantially the same plane.

U.S. Pat. No. 5,538,213 discloses a support bracket for shelving comprising a main body having a vertical edge from which extend a plurality of spaced apart, outwardly directed hooks for mounting the bracket on a vertical support standard with said hooks extending into vertically spaced apertures in the standard; a lock for preventing removal of the bracket from the standard, said lock comprising a member that is movably mounted on the main body of the bracket for displacement towards and away from the support standard between a locked and unlocked position and including a portion adapted to engage in an aperture of the support standard, the lock being disposed on the vertical edge of the main body so that it enters and at least partially occupies an aperture of the support standard that is not partially occupied by one of the bracket's hooks.

U.S. Pat. No. 6,978,975 discloses a shelf system for releasable mounting of shelves or boards on a wall or standing by itself, said shelf system comprising: at least one supporting element which is essentially vertically positioned and has slots or grooves, at least one plate-shaped shelf bracket having a longitudinal plane which is adapted to support said shelf or board and which by means of a hook-shaped portion projecting from one end of said shelf bracket is adapted to be inserted into a chosen slot and engage with an area of the supporting element adjacent to the slot for sustaining the shelf bracket in the supporting element, and a locking element for releasable locking of the shelf bracket on the supporting element, wherein the hook-shaped portion has a fastening end which is directed upwards in a mounting position of the shelf bracket and is defined by a recess in the shelf bracket and by an essentially arc-shaped circumferential surface extending downwards from the uppermost portion of the recess and terminating at said end of said shelf bracket, wherein the distance between the termination of said circumferential surface and the recess corresponds to the height of the slot in order to enable the hook shaped portion to fit through the slot, wherein the shelf bracket is adapted to be applied obliquely from above into the supporting element and subsequently be pivoted in place downwards, and wherein the recess has a width that is greater than the material thickness of the supporting element in said slot area for releasable receiving of the locking element, which locking element is adapted to be positioned perpendicular to the longitudinal plane of the shelf bracket and the width of the recess is small enough such that the recess engages with the locking element to prevent the shelf bracket from being unintentionally detached from the supporting element when the locking element is in the recess, whereby the shelf bracket is locked in a releasable manner on the supporting element.

GENERAL DESCRIPTION

According to a first aspect of the present disclosure there is provided a rack system comprising at least one support rail configured with a plurality of axially extending bracket arresting slots and a plurality of corresponding locking locations, and at least one support bracket comprising at least two axially disposed engaging hooks readily detachably attachable with any two or more of the bracket arresting slots of the support rail, said support bracket further comprising a locking mechanism comprising a locking plunger configured for engaging with a locking location at the support rail.

The term rack system is used in its broad sense and denotes any rack support system configured as a wall mountable rack support system, for any purpose, e.g. a shelving system and the like. The term wall refers to any support element to which a support rail according to the disclosure can be applied, either stationary or mobile.

The term support bracket denotes a cantilever-type element detachably attachable to a support rail, said support bracket can be used for supporting any type of load, e.g. shelves, cargo, containers and the like, any items of utility and the like.

The arrangement is such that the support bracket can be attached or detached from the support rail only when the locking plunger is disengaged from a locking location, thereby preventing unintentional detaching, or attaching, of the support bracket from the support rail.

According to a particular example, the support rail is configured with a bracket arresting surface, comprising a plurality of paired bracket arresting slots, parallelly disposed in two rows, and the plurality of locking locations are configured as locking openings disposed in correspondence with each pair of slots, said locking openings disposed along a longitudinal axis extending between said rows.

According to another aspect of the present disclosure there is provided a support bracket configured for detachably attaching to a support rail, said support bracket comprising a body extending between a first, engaging end, and a second end, wherein the engaging end comprises at least a pair of axially disposed engaging hooks projecting from the engaging end and configured for sliding engagement within bracket arresting slots of a support rail, and a locking mechanism comprising a locking plunger normally biased into a projecting position from the engaging end, and a actuating member for displacing the locking plunger into a retracted position.

The engaging end of the support bracket defines an engaging surface configured for at least partially sliding and bearing over at least a portion of the bracket arresting surface of the support rail.

According to one example, the support bracket has a body comprising two parallelly extending side walls with a space therebetween, at least near the engaging end, said space accommodating the locking mechanism, with an actuation opening at least at one of the side walls extending in register with a portion of the locking mechanism.

According to a particular example, the support bracket is configured with two or more pairs of parallelly disposed engaging hooks, and wherein each pair of engaging hooks is equally spaced from each other pair of engaging hooks along the longitudinal axis.

Any one or more of the following features, designs and configurations can be applied to the support bracket and/or rack system according to the present disclosure, separately and in various combinations thereof:

The engaging hooks of the support bracket can coextend from the side walls of the body;

The engaging hooks of the support bracket can extend flush with the side walls of the body;

The engaging hooks can be axially disposed along a longitudinal axis of the support bracket, and the engaging surface of the body can extend along an axis normal to said longitudinal axis;

The support rail can be configured for attaching to any substantially vertically extending support wall or any carrying wall surface;

The body of the support bracket can be made of sheet metal;

The body of the support bracket can be made of reinforced molded polymer;

The locking mechanism of the support bracket can comprise one or more locking plungers, all of which being actuated between a normally projecting position and a retracted position by manipulating a single actuating member;

When the locking plunger of the support bracket is received within a locking opening of the support rail, the engaging surface of the support bracket is prohibited from sliding over the bracket arresting surface of the support rail, thus prohibiting axial sliding displacement into engagement or disengagement from the support rail;

The retracing member can be accommodated within a space of the body defined between two parallelly disposed side walls;

The actuating member can be configured for only sliding displacement within the space extending between the side walls of the body;

The retracing member can be configured with a body portion having a body width corresponding with the width of the space between the parallelly extending side walls of the bracket body, and a sliding limit projecting from the body portion, having a width greater then said space width and projecting into the actuation opening of the side wall, thereby restricting sliding displacement of the retracing member between a forward projecting position and a rearward, retracted position;

The body portion of the retracing member can be configured with a through-going finger engaging location, disposed in register with actuation openings at the side walls, said finger engaging location being smaller than the actuation openings;

The finger engaging location can be configured with a laterally projecting rim portion defining said sliding limit;

Manipulating the retracing member can be in a trigger-like actuation fashion, actuated by a single finger;

The locking plunger can be integral with the actuating member;

The actuating member with the locking plunger can be biased into the projecting position by a biasing member extending between a bearing portion of the extracting member and a support portion of body;

The bearing portion and the support portion can be coaxially configured;

The support portion of the body can be configured as a surface inwardly extending from a side wall of the body;

The biasing member can be a coiled spring extending between the bearing portion and the support portion;

The bracket arresting locations can be configured as parallelly disposed slots axially extending along the longitudinal axis;

The locking locations can be configured as round openings;

A tip of the plunger can be rounded or chamfered to facilitate easy engagement within corresponding locking locations of the support rail;

The locking locations can be disposed in register with the plurality of bracket arresting locations;

The locking locations and the bracket arresting locations are equidistantly distributed along a longitudinal axis;

The body of the support bracket can be configured out of a unitary folded sheet material;

A spring support portion of body can be an integral portion of a side wall, bent into the accommodating space;

The locking mechanism can be snappingly articulated within the space;

The support bracket can be used as a single member bearing a load, or it can be used in pairs;

The support bracket can be configured with one or more articulating locations, for securing thereto a variety of utility units;

The one or more articulating locations can be disposed over, under and a side walls of said support bracket;

At least a top portion of the support bracket can be configured with an articulation mechanism for detachably attaching thereto a variety of utility units;

The articulation mechanism can be configured as a snap-type coupling, bayonet coupling, male-female coupling, dovetail coupling, clasp and latch coupling etc.;

The support bracket can be configured for sliding supporting one or more utility units or a utility support platform, which said utility support platform is configured for detachably attaching thereto one or more utility units.

The term utility unit as used herein denotes any article of utility, either stationary of mobile, having a utility and being detachable attachable to other utility units. A utility unit according to the present disclosure can be, by way of example, any type of container, drawer shed, work surface, locomotion system, mounting system, and the like.

BRIEF DESCRIPTION OF THE DRAWINGS

In order to better understand the subject matter that is disclosed herein and to exemplify how it may be carried out in practice, embodiments will now be described, by way of a non-limiting example only, with reference to the accompanying drawings, in which.

DETAILED DESCRIPTION OF EMBODIMENTS

Figure 1A:
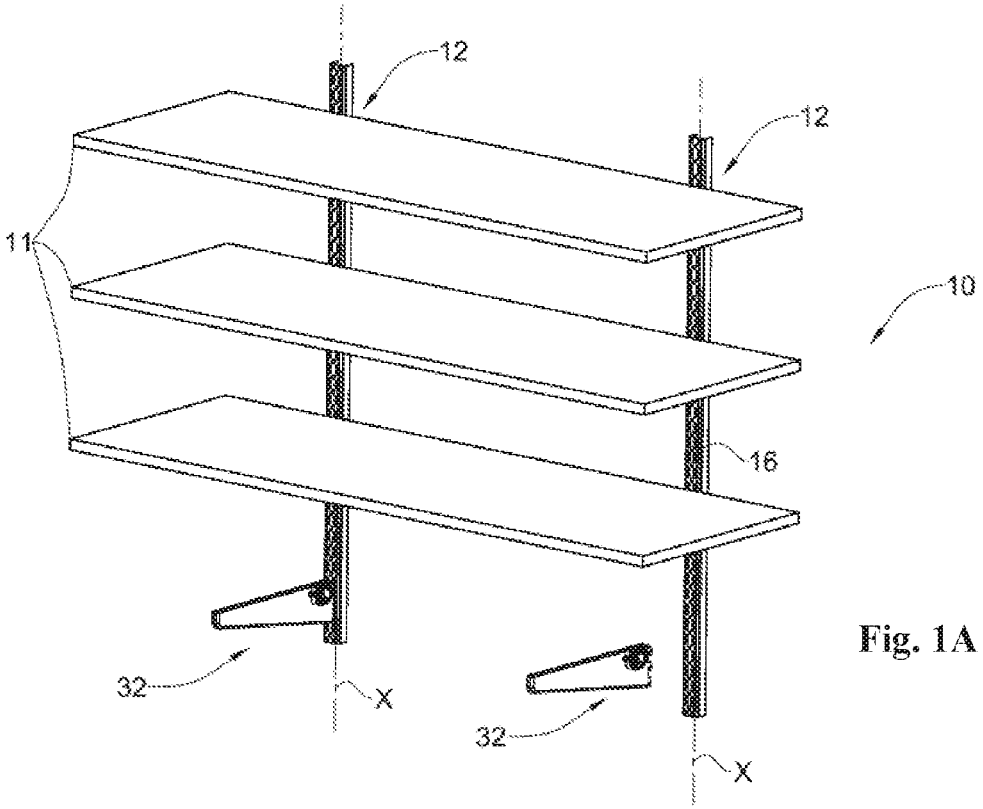
FIG. 1A is a top perspective view of a rack system according to an embodiment of the present disclosure.
Figure 1B:
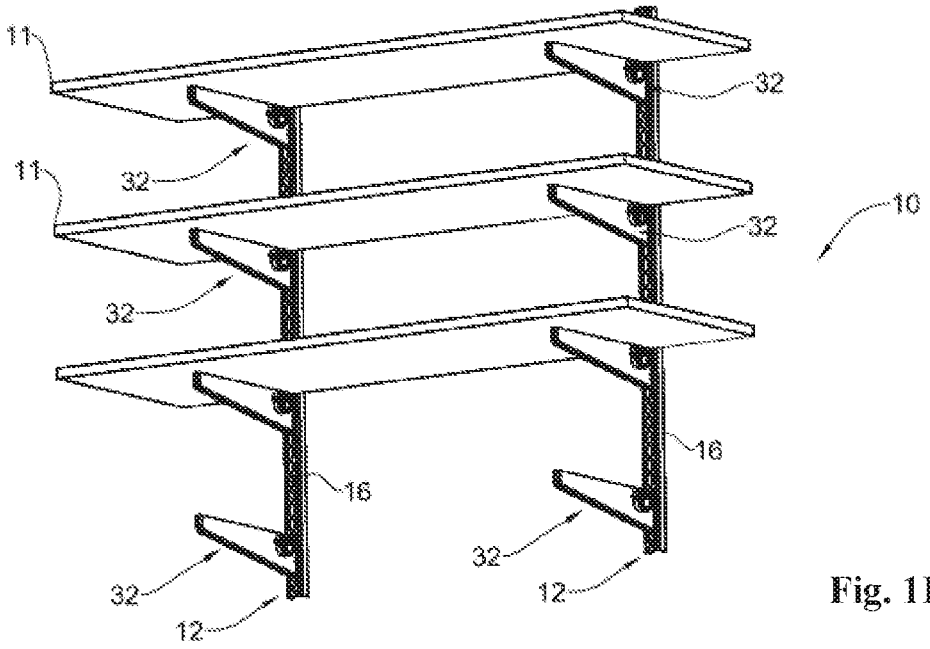
FIG. 1B is a bottom perspective view of a rack system according to an embodiment of the present disclosure.

Turning first to FIGS. 1A and 1B of the drawings, there is illustrated a rack system according to an example of the disclosure, generally designated 10. The rack system illustrated in the example is a shelving system, comprising a plurality of shelves 11, though it is appreciated that the rack system can assume different configurations for different purposes.

With further reference to FIGS. 2A-6D, the rack system 10 comprises two support rails 12 parallelly extending, vertically, along a longitudinal axis X. The support rails 12 are configured for articulation to any wall (not shown) and are configured of sheet metal having a substantially rectangular section with a flat bracket arresting surface 16. The bracket arresting surface 16 is configured with two rows of bracket arresting slots 20A and 20B (collectively designated 20) disposed parallelly to axis X. The bracket arresting slots are arranged in pairs, horizontally spaced apart at a distance d, equally axially distanced from one another at a distance D, and each slot having a height H and a width W.

Further, bracket arresting surface 16 is configured with a plurality of locking locations, namely circular openings 26, said openings disposed along the longitudinal axis X and equally distanced from one another, extending between the pairs of bracket arresting slots 20A and 20B.

Figure 2A:
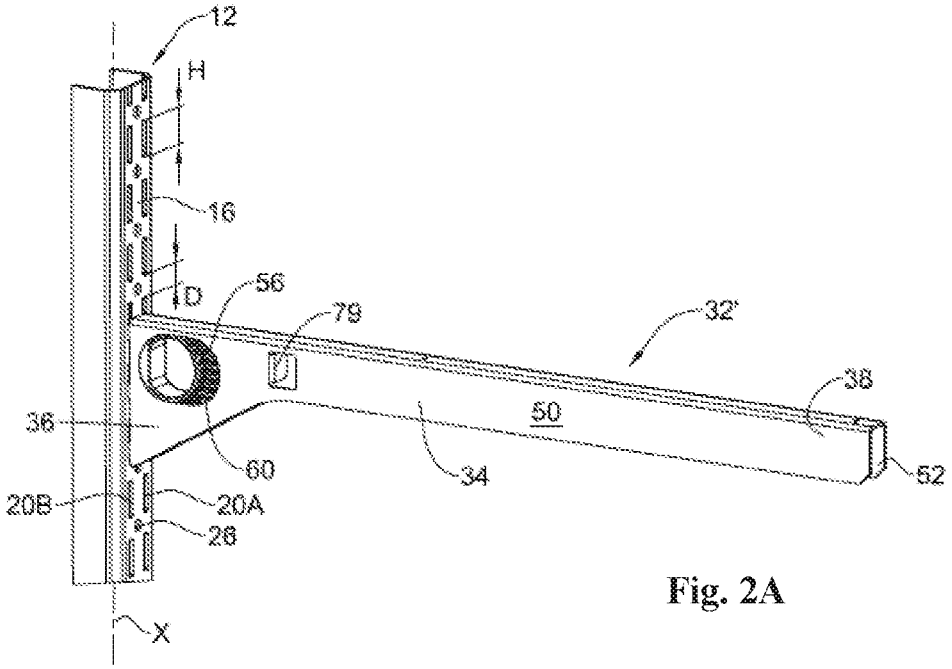
FIG. 2A is a top perspective view of a support bracket according to an exemplary design of the disclosure, articulated to a support rail.
Figure 2B:
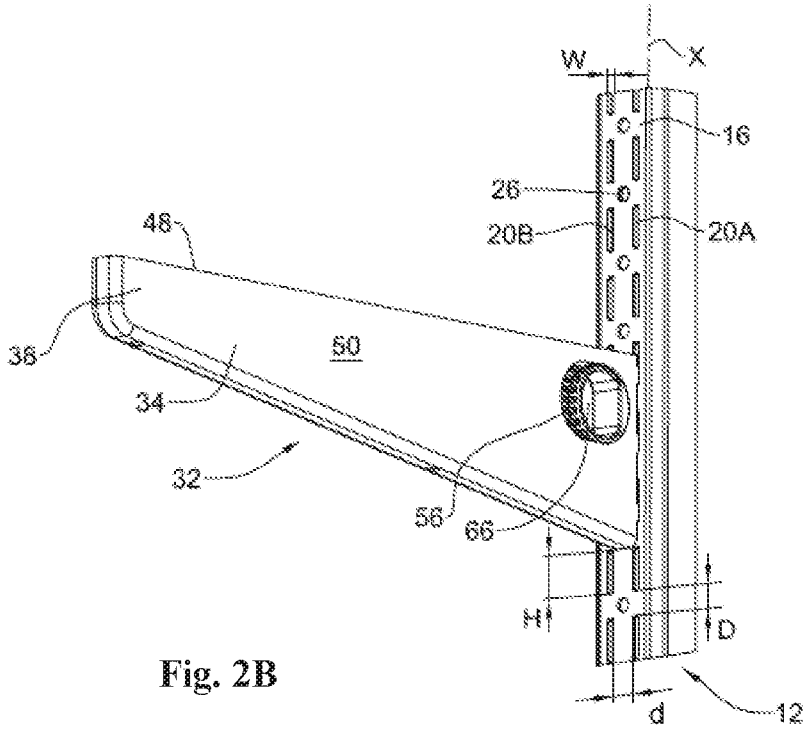
FIG. 2B is a bottom perspective view of a support bracket according to an exemplary design of the disclosure, articulated to a support rail.
Figure 3:
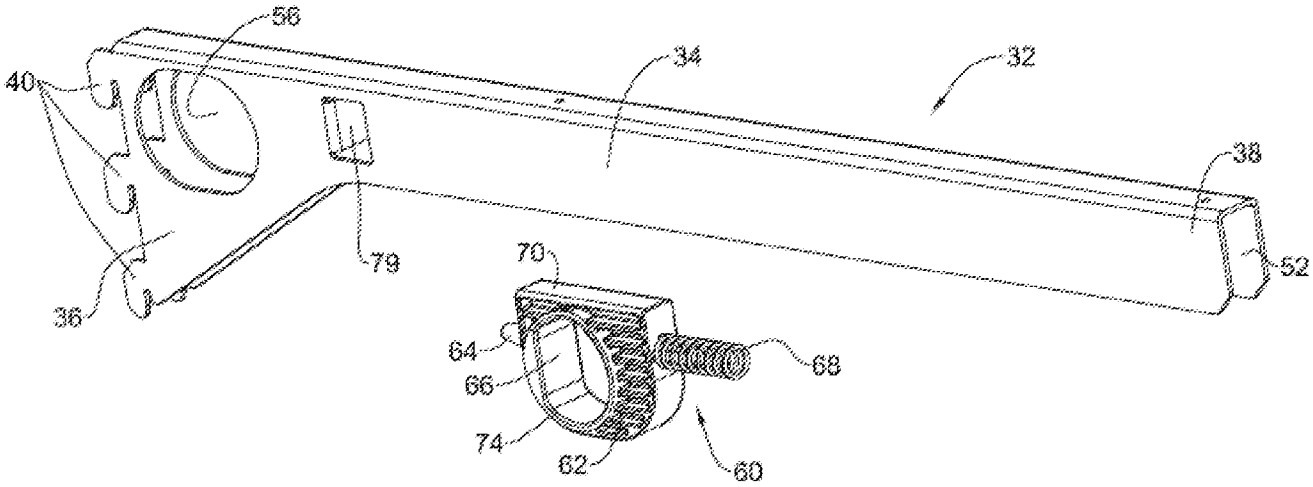
FIG. 3 is an exploded rear perspective view of a support bracket of FIG. 2A.
Figure 4B:
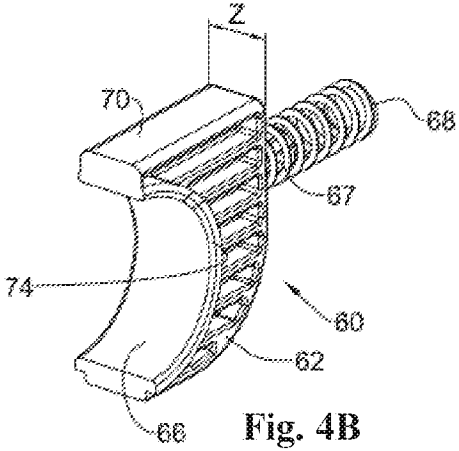
FIG. 4B is a section along line I-I in FIG. 4A.
Figure 4A:
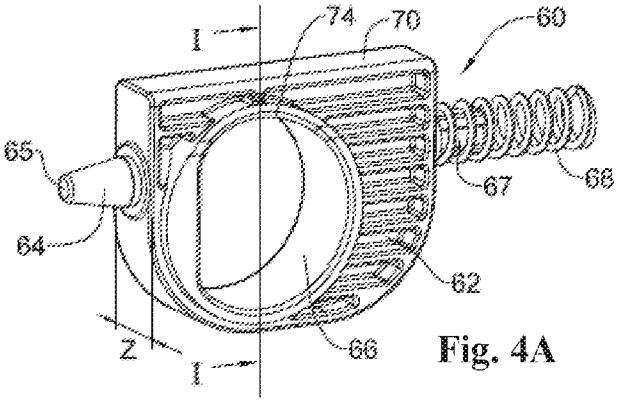
FIG. 4A is a front perspective view of a locking mechanism of the support bracket of FIG. 3.
Figure 5C:
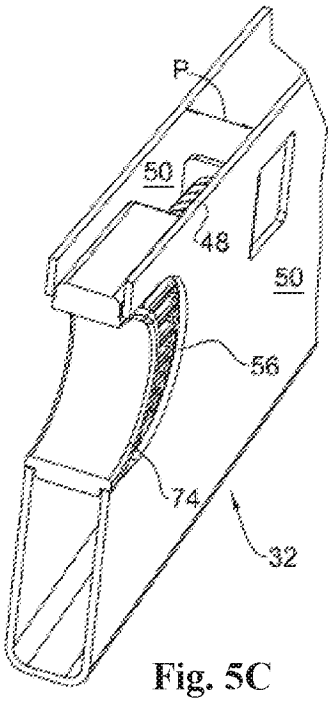
FIG. 5C is a section taken along line II-II in FIG. 5B.
Figure 5B:
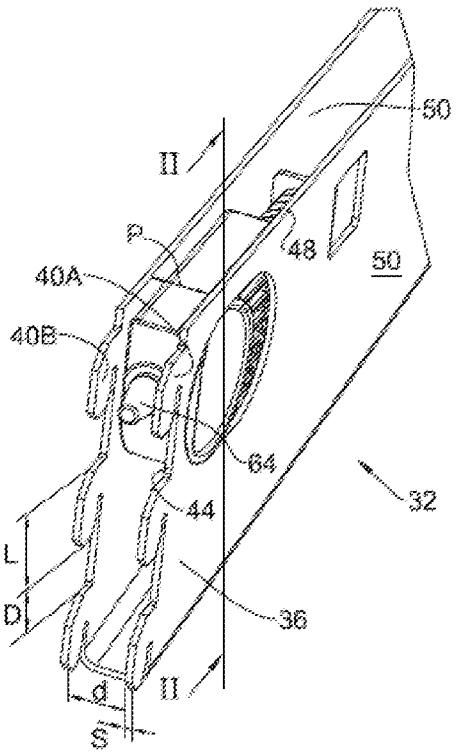
FIG. 5B is a front perspective view of the portion shown in FIG. 5A.
Figure 5A:
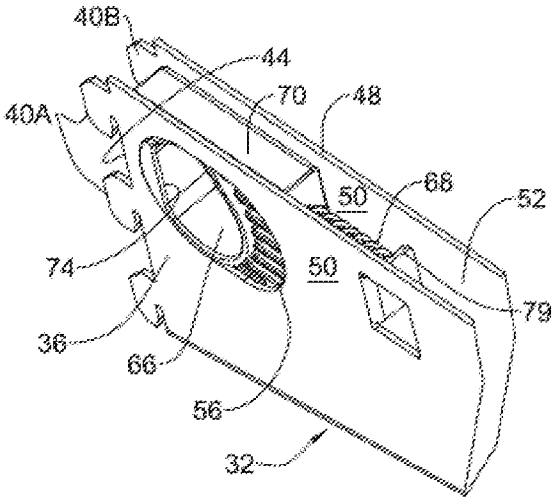
FIG. 5A is a rear perspective view of an engaging end portion of the support bracket, at enlarged scale, the locking mechanism at a normally projecting position.
Figure 6A:
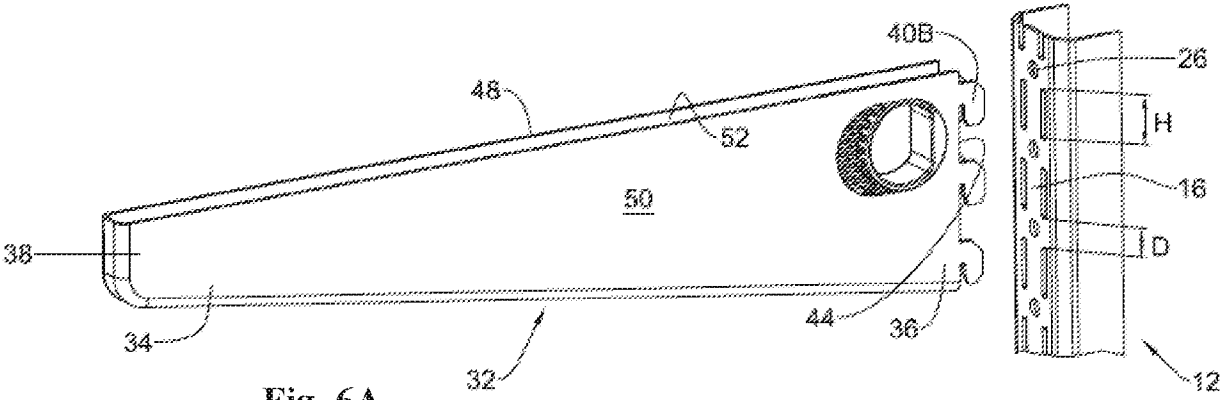
FIGS. 6A to 6D are rear perspective views, illustrating consecutive steps of articulating a support bracket to a support rail, according to the present disclosure.
Figure 6B:
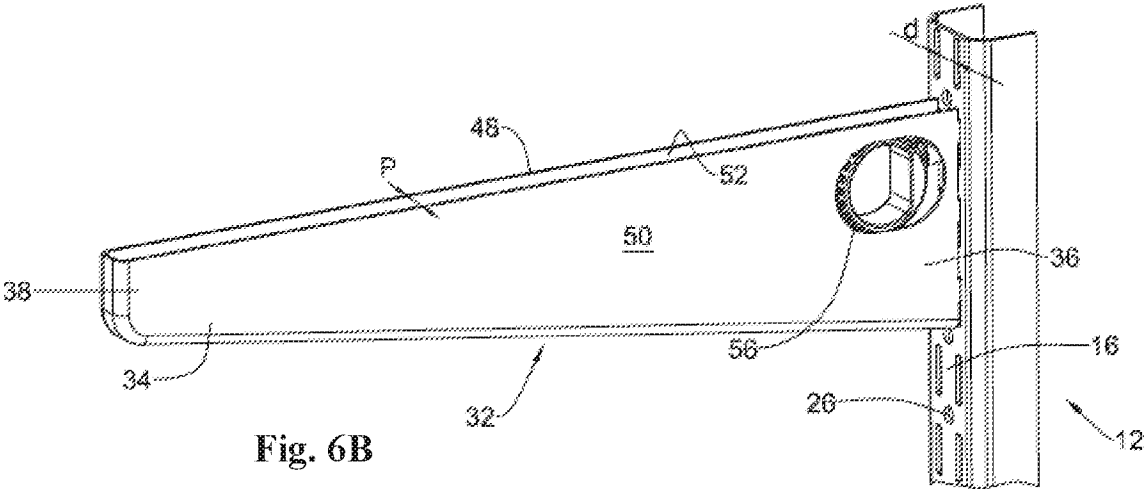
Figure 6C:
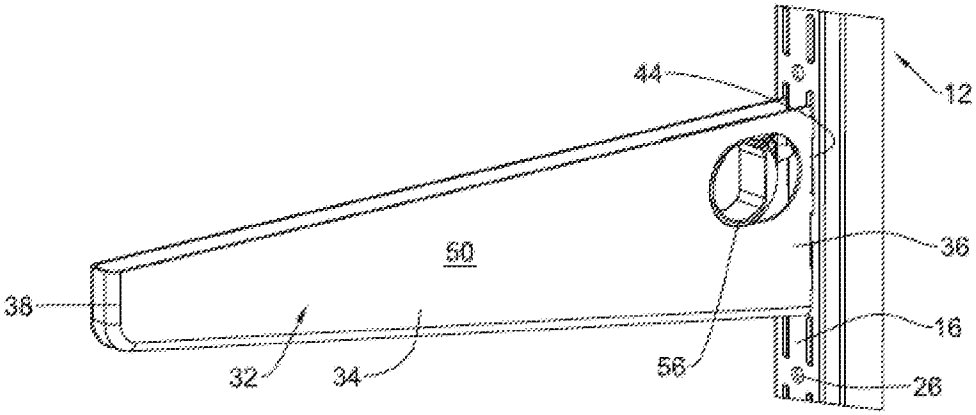
Figure 6D:
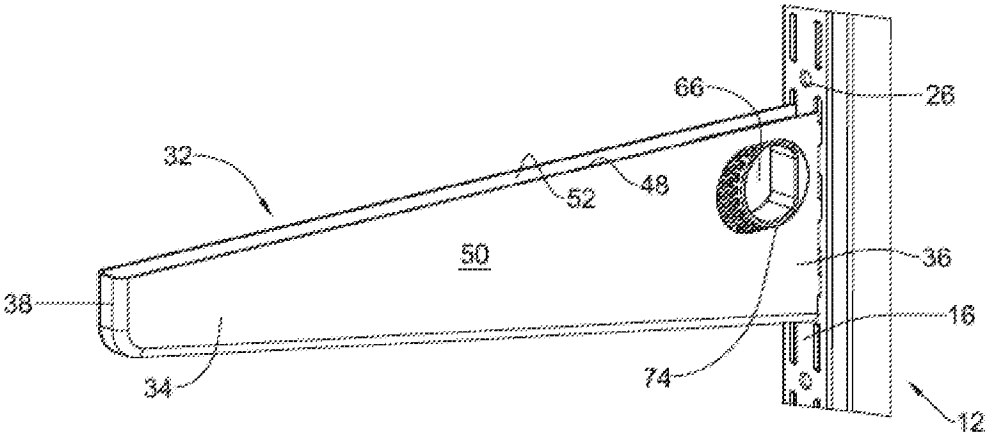
Figure 7A:
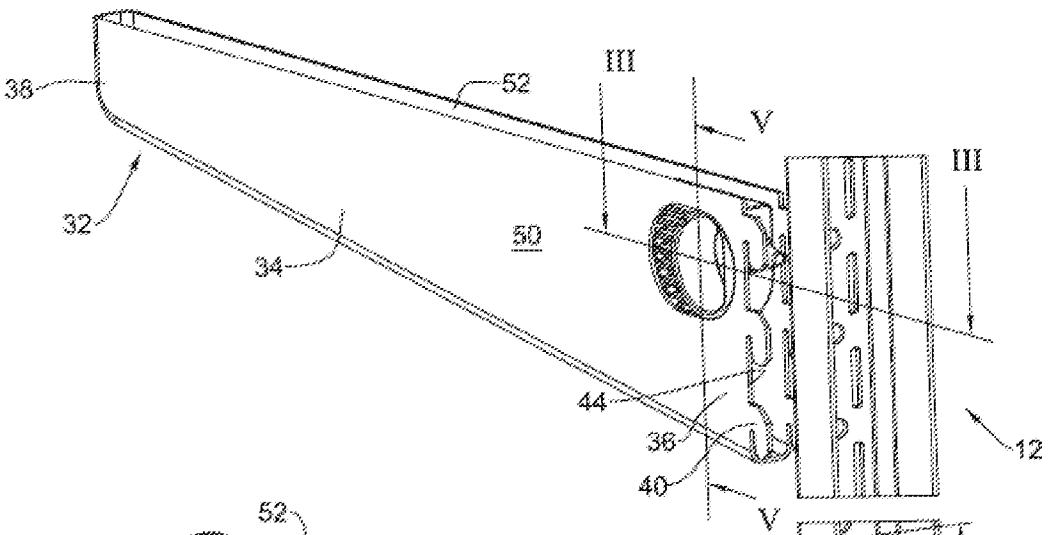
FIGS. 7A to 7D are front perspective views, corresponding with the consecutive steps illustrated in FIGS. 6A to 6D.
Figure 7B:
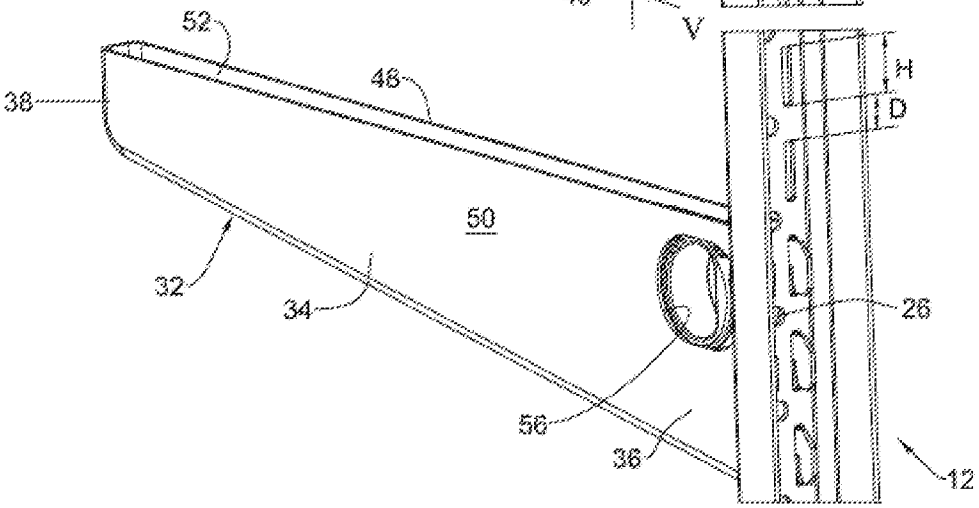
Figure 7C:
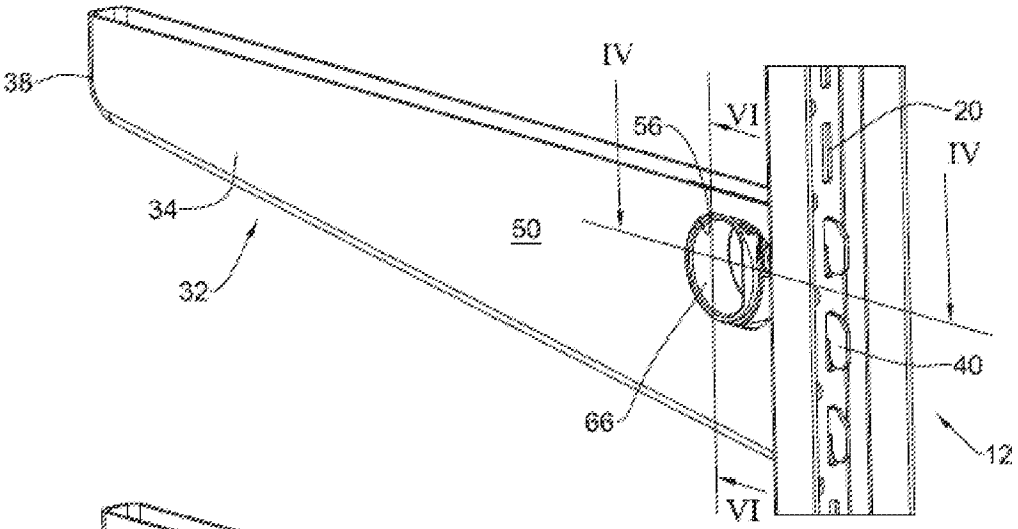
Figure 7D:
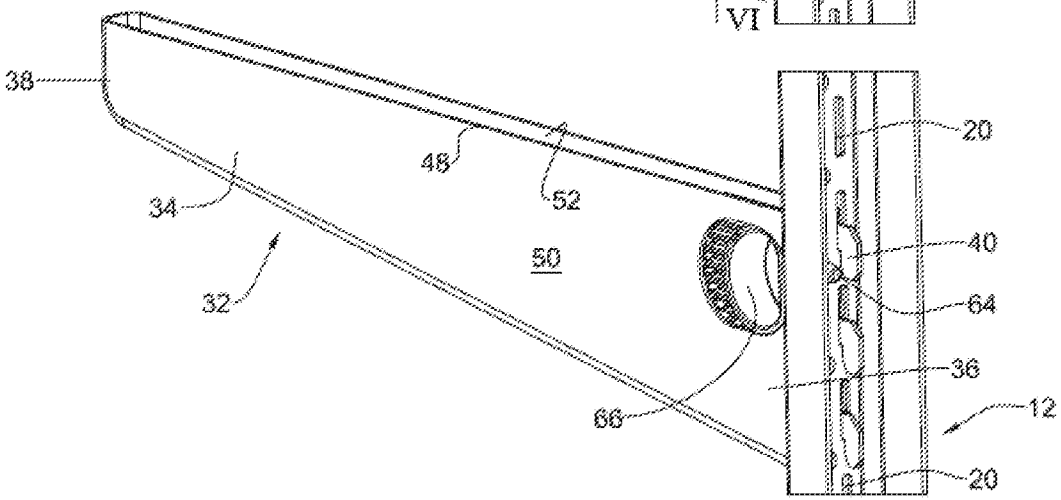
Figure 8B:
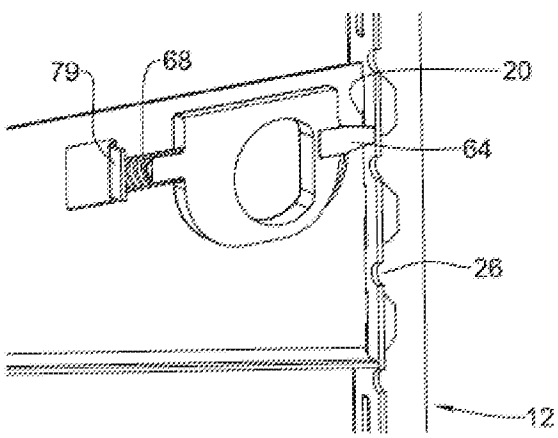
FIGS. 8A to 8E are perspective side views of the engaging end, vertically sectioned through a centerline of the support bracket, illustrating consecutive steps of articulating the support bracket to the support rail, according to the present disclosure.
Figure 8A:
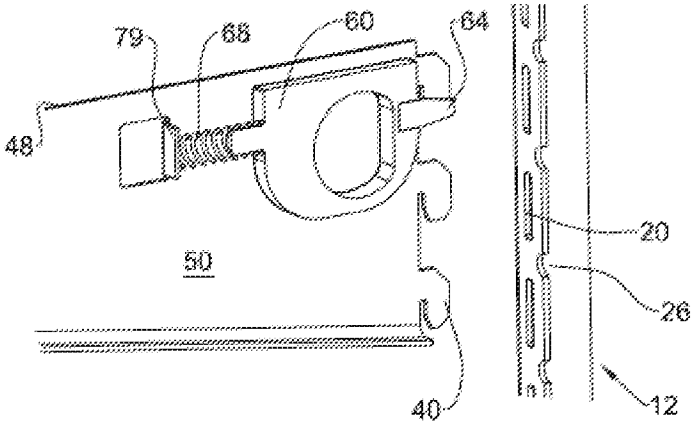
Figure 8C:
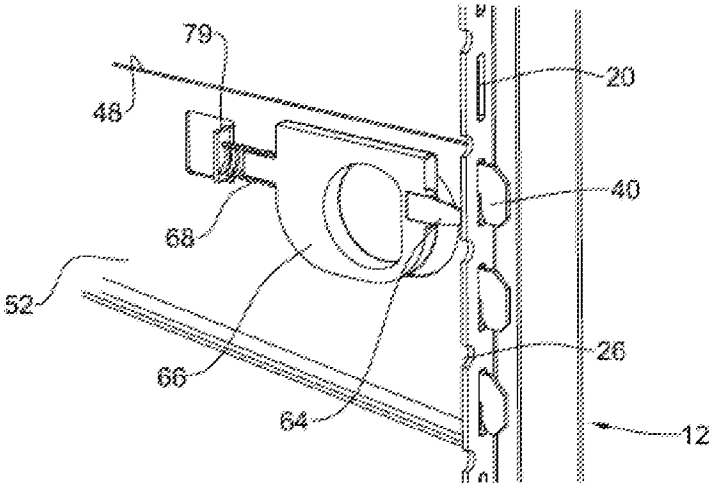
Figure 8E:
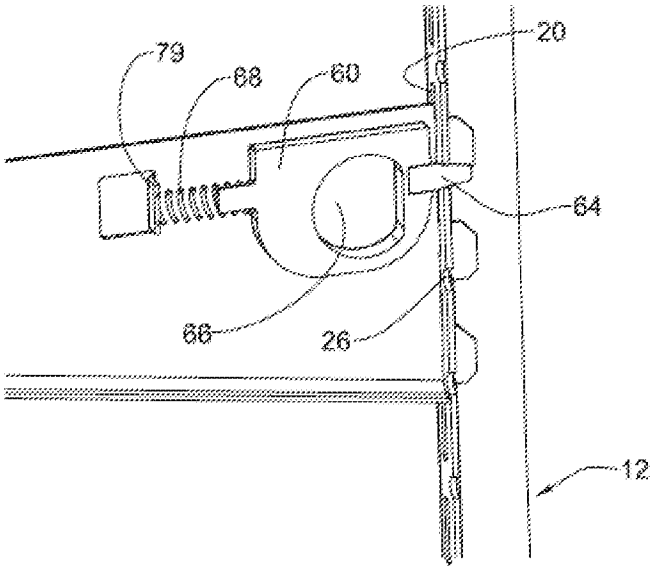
Figure 8D:
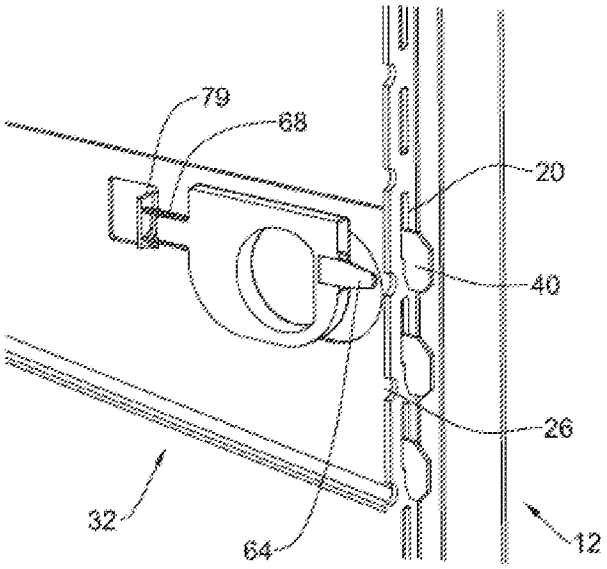
Figure 9B:
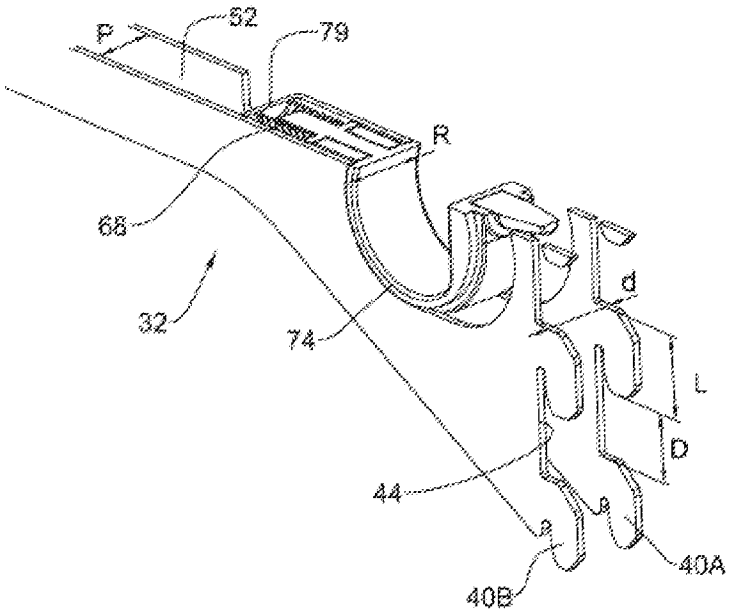
FIG. 9B is a front perspective view of the engaging end of a bracket, horizontally sectioned along line IV-IV in FIG. 7C the locking mechanism at the fully retracted position.
Figure 9A:
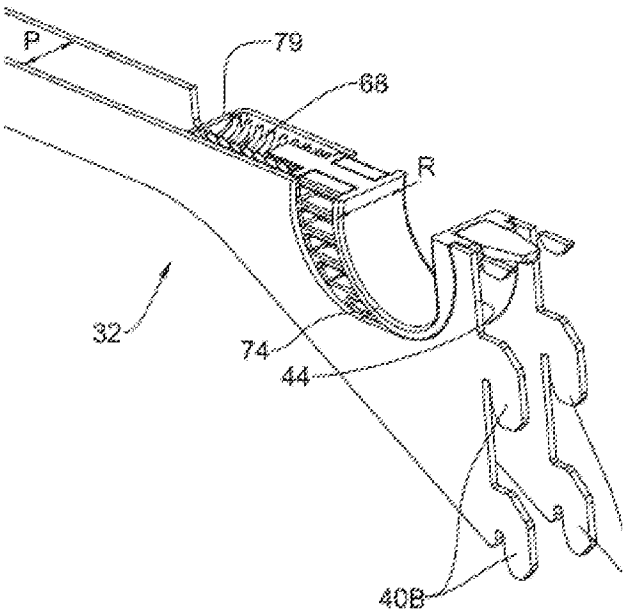
FIG. 9A is a front perspective view of the engaging end of a bracket, horizontally sectioned along line III-III in FIG. 7A, the locking mechanism at the fully projecting position.
Figure 9D:
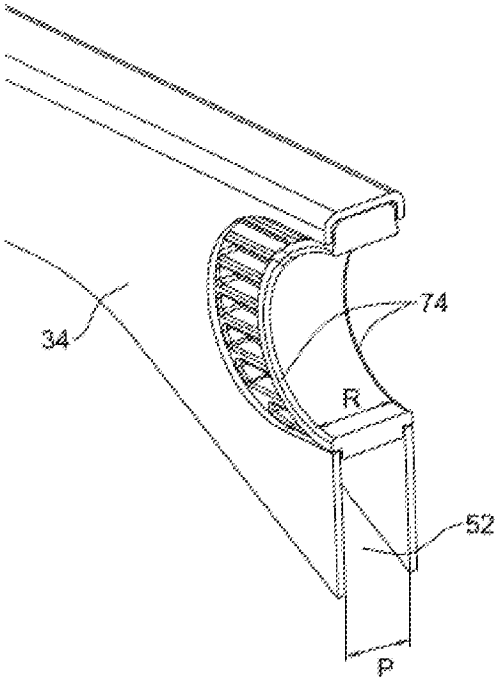
FIG. 9D is a front perspective view of the engaging end of a bracket, vertically sectioned along line VI-VI in FIG. 7C the locking mechanism at the fully retracted position.
Figure 9C:
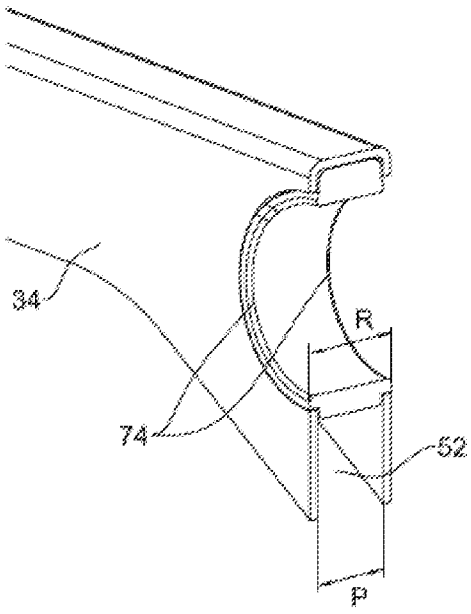
FIG. 9C is a front perspective view of the engaging end of a bracket, vertically sectioned along line V-V in FIG. 7A, the locking mechanism at the fully projecting position.

A plurality of brackets 32 are detachably attached to the support rails 12. In FIG. 2A the bracket 32' has a slightly different design, wherein it is configured with a uniform arm portion extending from a rail engaging end thereof, though is functionally similar to brackets 32). Each bracket 32 comprises a rigid body 34 extending between a first, rail engaging end 36, and a second, free end 38, wherein the engaging end 36 comprises three pairs of downwardly facing, axially disposed, engaging hooks 40A and 40B (collectively designated 40) projecting from the engaging end 36. The length L of engaging hooks 40 is slightly less than height H of arresting slots 20 (H>L) and the width S of the engaging hooks 40 is slightly less than the width W of the arresting slots 20 (S<W). Further wherein the axial distance between axially neighboring engaging hooks 40 is substantially equal to distance D (the axial distance between arresting slots 20). The horizontal distance d between a pair of engaging hooks 40A and 40B is substantially equal to distance between a pair of arresting slots 20.

The engaging hooks 40A and 40B project from an engaging surface 44, said surface configured for sliding engagement over the bracket arresting surface 16 of the support rail 12. A top portion of the support bracket 32 defines a support surface 48, which in the present example extends perpendicular to the engaging surface 44.

The body 34 of the bracket 32 is configured, according to an example, of bent metal sheet material, though it can be made also in different techniques and materials, e.g. of reinforced polymeric material. The body comprises two parallelly extending side walls 50 defining therebetween a space 52 of width P. Each of the side walls 50 is configured near the rail engaging end 36 with an elliptically shaped window 56, in register with one another, having a long axis laying substantially parallel to a longitudinal axis of the bracket 32.

Disposed within the space 52, there is snappingly set a locking mechanism 60 (FIGS. 3-4B), comprising a rigid body 62 (actuating member) configured at a front end thereof with a tapering locking plunger 64 having a rounded/chamfered tip 65 and a round finger engageable actuating opening 66. Extending from a rear wall of the body 62 there is a spring retention boss 67 (FIG. 4A) supporting a coiled compression spring 68. Body 62 has a flat top surface 70 and has a width Z only slightly less than the width P of the space 52 within the bracket 32, thus fitted for sliding displacement within the space 52. The actuating opening 60 is configured with a rim 74 having a width R greater than the width P of space 52 (P<R), said rim being substantially circular with a diameter corresponding with the short axis of the elliptical window 56 of the bracket 32, whereby the locking mechanism 60 is restricted for sliding displacement within and along the long axis of the window 56.

When assembling the locking mechanism 60 in the support bracket 32, it is snappingly applied into the space 52, with the rim 74 received within the window 56, and with a rear end of biasing spring 68 bearing against a support wall portion 79 cut out of a wall 50 and extending into the space 52.

At the assembled position the locking plunger 64 is normally biased into a projecting position from the engaging end 36 and owing to location of rim 74 within the elliptical window 56, the locking mechanism 60 is restricted to only sliding displacement within the space of the support bracket 32 between said projecting position and a retracted position, against the biasing effect of the coiled spring 68, by an individual manipulating the actuating member 62 in a trigger-like fashion, i.e. by inserting a finger into the opening 66 and displacing it rearwards, against the biasing effect, so that the plunger 64 retracts inwards.

In use, with reference to FIGS. 6A-9D, a bracket 32 is neared to the bracket arresting surface 16 of the support rail 12 (FIGS. 6A, 7A, 8A and 9A), then the locking mechanism 60 is retracted by pulling it rearwards within the opening 56, resulting in retraction of the plunger 64 (FIGS. 6B, 7B, 8B and 9B), whereupon the engaging surface 44 of bracket 32 is applied over the bracket arresting surface 16 so that the engaging hooks 40 engage within the arresting slots 20 and further the support bracket is displaced downwards into arresting of the engaging hooks 40 within the arresting slots 20 (FIGS. 6C, 7C, 8C and 9C), finally (after the actuating member 62 is released) allowing the locking plunger 64 to spontaneously engage within a corresponding locking locations (openings 26). Once the locking plunger 64 is engaged within a respective locking openings 26, the support bracket can no longer be axially displaced along the rail 12, namely the support brackets is engaged with the rail 12 and cannot unintentionally disengage therefrom, unless the locking mechanism is disengaged by retraction of the plunger.

The invention claimed is:

1. A support bracket configured for detachably attaching to a support rail, said support bracket comprising a body extending between a first, engaging end, and a second end, wherein the engaging end comprises at least a pair of axially disposed engaging hooks projecting from the engaging end and configured for sliding engagement within bracket arresting slots of the support rail, and a locking mechanism comprising a locking plunger normally biased into a projecting position from the engaging end, and an actuating member for displacing the locking plunger into a retracted position, wherein the actuating member is accommodated within a space of the body defined between two parallelly disposed side walls, with one or more actuation openings defined in at least one of the side walls and extending in register with a portion of the locking mechanism, and wherein the actuating member is configured with a body portion having a body width corresponding with the width of the space between the parallelly disposed side walls of the body, and a sliding limit projecting from the body portion, having a width greater than a width of said space and projecting into the actuation openings, thereby restricting sliding displacement of the retracing member between a forward projecting position and a rearward, retracted position.

2. A rack system comprising at least one support rail configured with a plurality of axially extending bracket arresting slots and a plurality of corresponding locking locations, and at least one support bracket according to claim 1.

3. The rack system of claim 2, wherein the support bracket can be attached or detached from the support rail only when the locking plunger is disengaged from a locking location, thereby preventing detaching, or attaching, of the support bracket from the support rail.

4. The rack system of claim 2, wherein the support rail is configured with a bracket arresting surface, comprising said plurality of bracket arresting slots arranged in pairs, parallelly disposed in two rows, and the plurality of locking locations are configured as locking openings disposed in correspondence with each pair of slots, said locking openings disposed along a longitudinal axis extending between said rows.

5. The rack system of claim 2, wherein the bracket arresting locations are configured as parallelly disposed slots axially extending along the longitudinal axis.

6. The rack system of claim 2, wherein the locking locations are configured as round openings disposed between pairs of bracket arresting locations.

7. The rack system of claim 2, wherein the support bracket is configured with one or more articulating locations, for securing thereto a variety of utility units.

8. The rack system of claim 2, wherein the support bracket is configured with an articulation mechanism for detachably attaching thereto a variety of utility units.

9. The rack system of claim 2, wherein the support bracket is configured for sliding supporting one or more utility units or a utility support platform, which in turn is configured for detachably attaching thereto one or more utility units.

10. The support bracket of claim 1, wherein the engaging end of the support bracket defines an engaging surface configured for at least partially sliding and bearing over at least a portion of a bracket arresting surface of the support rail.

11. The support bracket of claim 10, wherein the engaging hooks are axially disposed along a longitudinal axis of the support bracket, and the engaging surface of the body extends along an axis normal to said longitudinal axis.

12. The support bracket of claim 10, wherein when the locking plunger of the support bracket is received within a locking opening of the support rail, the engaging surface of the support bracket is prohibited from sliding over the bracket arresting surface of the support rail, and prohibiting axial sliding displacement into engagement or disengagement from the support rail.

13. The support bracket of claim 1, wherein the support bracket is configured with two or more pairs of said engaging hooks, and wherein each pair of said engaging hooks is equally spaced from each other along the longitudinal axis.

14. The support bracket of claim 1, wherein the engaging hooks of the support bracket coextend flush from the side walls of the body.

15. The support bracket of claim 1, wherein the locking mechanism of the support bracket comprises more than one said locking plunger, all of which being actuated between the normally projecting position and the retracted position by manipulating a single actuating member.

16. The support bracket of claim 1, wherein the actuating member is configured for only sliding displacement within the space extending between the side walls of the body.

17. The support bracket of claim 1, wherein the body portion of the actuating member is configured with a through-going finger engaging location, disposed in register with open or more of the actuation openings, said finger engaging location being smaller than the actuation openings, wherein the finger engaging location is configured with a laterally projecting rim portion defining said sliding limit.

18. The support bracket of claim 1, wherein the actuating member with the locking plunger are biased into the projecting position by a biasing member extending between a bearing portion of the actuating member and a support portion of body.

19. The support bracket of claim 1, wherein the locking mechanism is snappingly articulated within the space.

20. The support bracket of claim 1, wherein the support bracket is configured with one or more articulating locations, for securing thereto a variety of utility units.

21. The support bracket of claim 1, wherein the support bracket is configured with an articulation mechanism for detachably attaching thereto a variety of utility units.

22. The support bracket of claim 1, wherein the support bracket is configured for sliding supporting one or more utility units or a utility support platform, which in turn is configured for detachably attaching thereto one or more utility units.

* * * * *